US010187963B2

(12) United States Patent
Van De Sluis et al.

(10) Patent No.: US 10,187,963 B2
(45) Date of Patent: Jan. 22, 2019

(54) GENERATING A LIGHTING SCENE

(71) Applicant: PHILIPS LIGHTING HOLDING B.V., Eindhoven (NL)

(72) Inventors: Bartel Marinus Van De Sluis, Eindhoven (NL); Berent Willem Meerbeek, Veldhoven (NL); Dirk Valentinus René Engelen, Heusden-Zolder (BE); Bas Driesen, Weert (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/775,039

(22) PCT Filed: Nov. 9, 2016

(86) PCT No.: PCT/EP2016/077075

§ 371 (c)(1),
(2) Date: May 10, 2018

(87) PCT Pub. No.: WO2017/081054

PCT Pub. Date: May 18, 2017

(65) Prior Publication Data

US 2018/0279446 A1 Sep. 27, 2018

(30) Foreign Application Priority Data

Nov. 11, 2015 (EP) ..... 15194032

(51) Int. Cl.
*H05B 37/02* (2006.01)
*H05B 33/08* (2006.01)

(52) U.S. Cl.
CPC ..... *H05B 37/029* (2013.01); *H05B 33/0863* (2013.01)

(58) Field of Classification Search
CPC ..... H05B 33/0863; H05B 37/0245
(Continued)

(56) References Cited

U.S. PATENT DOCUMENTS 6,611,297 B1 * 8/2003 Akashi ..... H04N 21/4131 348/602
7,894,000 B2 * 2/2011 Gutta ..... H04N 9/12 348/553

FOREIGN PATENT DOCUMENTS

EP 1551178 A1 7/2005
WO 2006003600 A1 1/2006
(Continued)

*Primary Examiner* — Daniel D Chang
(74) *Attorney, Agent, or Firm* — Akarsh P. Belagodu

(57) ABSTRACT

A method of creating a lighting scene, the method comprising: receiving a still or moving input image; identifying one or more image segments within the input image (S22), including determining a shape of each of the one or more image segments (S23); determining a respective color and/or brightness level of each of the one or more identified image segments; determining a shape associated with each of a one or more luminaires present within the environment; matching the shape of each of the one or more identified image segments to the shape associated with a respective one of said luminaires or a respective group of the luminaires (S25); and for each respective of the one or more identified image segments, controlling the respective luminaire or group of luminaires to emit light with a color selected based on the color of the respective image segment and/or with a brightness level selected based on the brightness level of the respective image segment (S26).

15 Claims, 2 Drawing Sheets

(58) Field of Classification Search
USPC ..... 315/294
See application file for complete search history.

(56) References Cited

FOREIGN PATENT DOCUMENTS

| | | | |
|---|---|---|---|
| WO | 2014027275 | A1 | 2/2014 |
| WO | 2014064629 | A1 | 5/2014 |
| WO | 2014087274 | A1 | 6/2014 |

* cited by examiner

GENERATING A LIGHTING SCENE

CROSS-REFERENCE TO PRIOR APPLICATIONS

This application is the U.S. National Phase application under 35 U.S.C. § 371 of International Application No. PCT/EP2016/077075, filed on Nov. 9, 2017, which claims the benefit of European Patent Application No. 15194032.7, filed on Nov. 11, 2015. These applications are hereby incorporated by reference herein.

TECHNICAL FIELD

The present disclosure relates to a process for generating a lighting scene based on an image such as a photograph selected by a user.

BACKGROUND

"Connected lighting" refers to a system of luminaires which are controlled not by (or not only by) a traditional wired, electrical on-off or dimmer circuit, but rather via a wired or more often wireless network using a digital communication protocol. Typically, each of a plurality of luminaires, or even individual lamps within a luminaire, may each be equipped with a wireless receiver or transceiver for receiving lighting control commands from a lighting control device according to a wireless networking protocol such as ZigBee, Wi-Fi or Bluetooth (and optionally also for sending status reports to the lighting control device using the wireless networking protocol). For instance the lighting control device may take the form of a user terminal, e.g. a portable user terminal such as a smartphone, tablet, laptop or smart watch; or a static user terminal such as a desktop computer or wireless wall-panel. In such cases the lighting control commands may originate from a lighting control application ("app") running on the user terminal, based on user inputs provided to the application by the user through a user interface of the user terminal (e.g. a touch screen or point-and-click interface). The user device may send the lighting control commands to the luminaires directly, or via an intermediate device such as a wireless router, access point or lighting bridge.

It is known to use a connected lighting system to generate a lighting scene based on an image selected by a user. The image could be a still image or moving image. It could be a captured image (photograph or filmed video) or could be a user created image (e.g. drawing or animation). In such cases the lighting control application samples ("picks") the colour and/or brightness values from one or more points or areas in the image, then uses these to set the colour and/or brightness levels of the illumination emitted by the luminaires providing the lighting scene. For instance the user may select a scene that has inspired him or her, such as an image of a forest or sunset, and the application sets the lighting based on this so as to recreate the colours of the image and therefore recreate the atmosphere of the scene shown in the image.

In one implementation, the lighting control application automatically extracts the dominant colours from the image and assigns them randomly to individual lighting devices, thereby recreating a lighting scene giving a feel of that shown in the image. In another implementation, the lighting control application knows the positions or at least relative positions of the luminaires within the environment in question (e.g. room) and maps each to a corresponding point in the image. It then treats each of the luminaires as a "lighting pixel" to recreate an approximation of the image in the environment.

SUMMARY

In the coming years, connected lighting systems are expected to experience a large growth in terms of the number of individually controllable colour light nodes typically present in a given environment (e.g. a given room). For instance, LED strips already support pixelated control, enabling each node to render individual colors. A big challenge is to provide suitable "lighting content" for this large number of color lighting pixels while at the same time keeping this simple for end-users.

Image-based lighting, whereby a scene is created based on an input image such as a photograph selected by a user, can enable easy creation of rich lighting scenes by exploiting the availability of billions of images and videos online, the proliferation of personal digital cameras, or indeed any other source of still or moving digital images. As mentioned, current solutions automatically extract the dominant colours from the image and assign them randomly to individual lighting devices. This approach gives an impression of the colours, but not of the patterns in the image. Other solutions treat each luminaire as a pixel and assign a colour and brightness to each in dependence on its position, in order to represent a corresponding point in the user-selected image. However, while these solutions recreate something of the pattern or structure in the image, it is recognized herein that they are still limited. Particularly, the shape of the lighting device or lighting effect is not taken into account.

Accordingly, the present disclosure provides a method of mapping image segments to corresponding lighting device shapes.

According to one aspect disclosed herein, there is provided method of creating a lighting scene illuminating an environment, the method comprising: receiving a still or moving input image; identifying one or more image segments within the input image, including determining a shape of each of the one or more image segments; determining a respective colour and/or brightness level of each of the one or more identified image segments; determining a shape associated with each of one or more luminaires present within said environment, or with each of one or more groups of said luminaires present within said environment; matching the shape of each of the one or more identified image segments to the shape associated with a respective one of said luminaires or a respective one of said groups of said luminaires; and for each respective of the one or more identified image segments, controlling the respective luminaire or group of luminaires to emit light with a colour selected based on the colour of the respective image segment and/or with a brightness level selected based on the brightness level of the respective image segment.

In embodiments, wherein the identification of at least one, or each, of said image segments may be performed by using an image recognition algorithm to recognize a corresponding object or region in the input image.

For example, the recognition may be based on the determined shape associated with each of the one or more luminaires, the image recognition algorithm searching the input image for the corresponding object or regions so as to be suitable for matching to the shape of the image segments.

In embodiments, the identification of at least one, or each, of said image segments may be performed by receiving a manual user selection of a user-selected region in the input image.

For example, the user-selected region is either: drawn free-form over the input image by a user, or drawn using a predetermined form having user-variable size and/or dimensions, or selected by a user dragging-and-dropping a predefined shape over the input image.

In embodiments, said matching may comprise matching the shape of at least one, or each, of the identified image segments to a shape associated with an individual respective one of said one or more luminaires; and the shape associated with at least one, or each, of the individual respective luminaires may be a shape of the individual luminaire, or a shape of a light emitting or diffusing part of the individual luminaire, or a shape of a group of light emitting or diffusing parts of the individual luminaire.

In embodiments, said matching may comprise matching the shape of at least one, or each, of the identified image segments to a shape associated with an individual respective one of said luminaires; and the shape associated with at least one, or each, of the individual respective luminaires may be a shape of a lighting effect cast by the respective luminaire.

In embodiments, said one or more luminaires may be a plurality of luminaires; and said matching may comprise matching the shape of at least one, or each, of the identified image segments to a shape associated with a group of said luminaires; and the associated shape may be a combined shape of the group.

In embodiments, said one or more luminaires may be a plurality of luminaires, and said one or more identified image segments may be a plurality of different image segments within the input image; and said matching may comprise matching the shape of each of the one or more identified image segments to the shape associated with a different respective one of said luminaires or a different respective group of said luminaires.

In embodiment, the method may further comprise selecting said one or more luminaires from amongst a larger number of luminaires, based on any one or more of: which are in the same room as one another, which are in the same room as a user, which are within a predetermined proximity of a user, a manual selection by a user, and/or which are most suitable for scene creation according to one or more predetermined criteria.

In embodiments, the determination of the shape of each of the one or more image segments may comprise categorizing the shape as either a first discrete category of shape or a second discrete category of shape, the first category defining more linear, rectangular and/or square forms of shape, while the second category defines more rounded shapes; the determination of the shape associated with each of the luminaires or groups of luminaires may comprise categorizing the shape as either the first category of shape or the second category of shape; and said matching may comprise matching at least one, or each, of the linear image segments to a linear one of said luminaires or groups on basis of both being linear, and/or matching at least one, or each, of the round image segments to a round one of said luminaires or groups of luminaires on basis of both being round.

In embodiments, the determination of the shape associated with each of the luminaires or group of luminaires may be based on any one or more of: using an ID of the luminaire or group to look up the associated shape in a data store mapping IDs to shapes; determining a model of the luminaire, wherein a predetermined shape is assumed to be associated with the model; using a camera and/or one or more other sensors to detect the associated shape, and/or a user input indicating the associated shape.

In embodiments, the input image may be selected by a user.

According to another aspect disclosed herein, there is provided a computer program product comprising code embodied on a computer-readable storage medium and configured so as when run on one or more processors top perform operations in accordance with any of the methods disclosed herein.

According to another aspect disclosed herein, there is provided a lighting control device configured to perform operations in accordance with any of the operations disclosed herein.

BRIEF DESCRIPTION OF THE DRAWINGS

To assist understanding of the present disclosure and to show how embodiments may be put into effect, reference is made by way of example to the accompanying drawings in which.

DETAILED DESCRIPTION OF EMBODIMENTS

The following describes a method for creating image-based lighting scenes, according to which the following steps are performed:

a) acquiring shape-related input from available lighting devices and/or their light effects,
b) processing the image content to detect prominent light or colour segments in the image (including corresponding prominent colour values and shapes for those segment),
c) matching prominent image segments to lighting devices based on similarity in shape, and
d) generating lighting control values for each lighting device such that the lighting device renders a color pattern corresponding to the image segment.

Optionally, the shapes of a group of lighting devices can be combined into a single shape.

Also, as an alternative to step (a), the user can create shapes or drag pre-defined shapes on the image, after which image processing is applied to extract the light or color information from the image segment defined by the shape.

The shape of the segments identified in step (b) may be based on detecting automatically detecting the most prominent segments, or automatically detecting prominent image segments that are most suitable for matching to the lighting device and/or light effect shapes identified in step (a). I.e. the image processing may be optimized towards shapes related to the shapes associated with the involved or available target luminaires 4. For instance if the lighting control application knows there are n linear shaped device and m round device, it will search for n prominent linear segments and m prominent round segments in the image.

Figure 1:
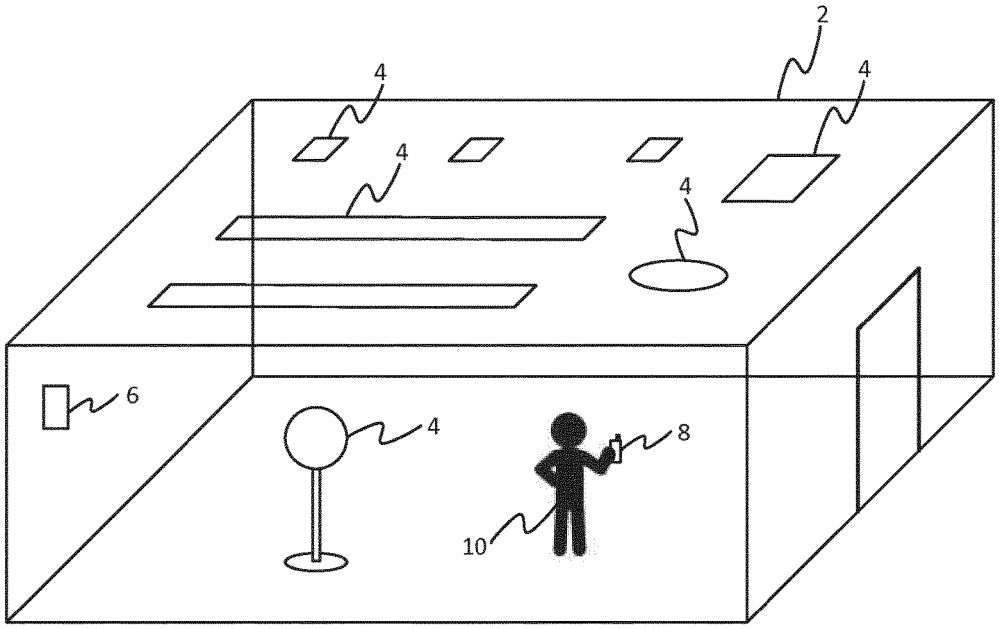
FIG. 1 is a schematic illustration of an environment equipped with a lighting system.

FIG. 1 shows a lighting system installed or otherwise disposed in an environment 2, e.g. an indoor space such as a room, or an outdoor space such as a garden or park, or a partially covered space such as a gazebo, or any other space that can be occupied by one or more people such as the interior of a vehicle. The lighting system comprises a plurality of luminaires 4, each comprising one or more lamps (illumination emitting elements) and any associated housing, socket(s) and/or support. A luminaire 4 is a lighting device for emitting illumination on a scale suitable for illuminating an environment 2 occupiable by a user. For example, each of the luminaires 4 may take the form of a ceiling mounted luminaire, wall mounted luminaire, wall washer, or a free standing luminaire (and each need not necessarily be of the same type).

Further, in accordance with the present disclosure, the luminaires 4 in the environment 2 comprise luminaires having substantially different shapes. The shape considered herein may be the overall shape of the housing of an individual luminaire 4, or the shape of an individual light emitting part (lamp) or the shape of an individual light diffusing part of an individual luminaire 4, or the shape of a group of light emitting parts or light diffusing parts of a given luminaire 4. Alternatively the shape may refer to the shape of the illumination cast by the luminaire 4 within the environment 2.

For instance, in a non-limiting example, one or more of the luminaires 4 each take the form of a long, thin strip (e.g. an LED based substitution for a fluorescent tube mounted on the ceiling), while one or more others of the luminaires take a circular or at least more rounded form (e.g. a round ceiling mounted luminaire or free standing lamp with a "blob" shaped diffuser or light shade). Embodiments in the following may be described in terms of strip lighting and round or blob shaped luminaires 4, but it will be appreciated that this is not limiting, and alternatively or additionally the luminaires 4 in question may comprise one or more substantially triangular luminaires 4, hexagonal luminaires 4, star-shaped luminaires 4, etc.

The lighting system further comprises a lighting control device 8 in the form of a user terminal installed with a lighting control application (or "app"). E.g. the user terminal 8 may take the form of a mobile user terminal such as a smartphone, tablet, laptop or smartwatch; or a static user terminal such as a desktop computer or wall-panel. The user terminal 8 comprises a user interface such as a touchscreen or a point-and-click interface arranged to enable a user 10 (e.g. a user present in the environment 2) to provide user inputs to the lighting control application. The user terminal 8 is arranged to connect to the luminaires via a wired networking protocol such as DMX or Ethernet or a wireless networking protocol such as ZigBee, Wi-Fi or Bluetooth, and thereby to enable the lighting control application to control the colour and/or brightness of the illumination emitted by the luminaires 4 based on the user inputs, in accordance with the following techniques. To do this, the user terminal 8 may connect directly to the luminaires 4, or may connect to them via an intermediate device 6 such as a wireless router, access point or lighting bridge. For instance the user terminal 8 may connect to the bridge 6 via a first wireless access technology such as Wi-Fi, while the bridge 6 may connect onwards to the luminaires via a second wireless access technology such as ZigBee. In this case the user terminal 8 sends the relevant lighting control commands to the luminaires 4 via the bridge 6, and the bridge 6 converts the lighting control commands from the first protocol to the second.

Alternatively some of the functionality described herein may be implemented on another device such as the bridge 6, or another device such as a dedicated centralized lighting controller or a server (comprising one or more server units at one or more geographical sites). E.g. in the case of some of the application being hosted on a server, the user terminal 6 may send inputs to the server via a wireless router or access point, and optionally via a further network such as the Internet. The inputs may then be processed at the part of the application hosted on the server to generate the relevant lighting control commands which the server may then forward to the luminaires 4, again via the wireless router or access point and in embodiments the further network. Alternatively the server may return information based on the received inputs back to the user terminal 8, for the user terminal 8 to generate the lighting control commands to send to the luminaires 4.

By way of example the following may be described in terms of control by a lighting control application running on the user terminal 8, but it will be appreciated that implementations where part of the functionality is implemented elsewhere are also possible.

According to techniques disclosed herein, the lighting control application on the user terminal 8 is configured to receive a user input selecting a still image (e.g. photograph) or moving image (e.g. captured video) selected by the user 10, this being an image the user 10 wishes to use to generate a lighting scene. E.g. this could be an image the user had downloaded to the user device 8 from the Internet, or which the user 10 has captured through a camera embedded in or connected to the user terminal 8. The lighting control application then identifies one or more shapes in the image, either by using an image recognition algorithm to detect the shape of one or more objects and/or regions in the image, or by receiving another user input from the user to select the shape of an region within the image (e.g. by dragging-and-dropping a predefined shape template over the image or drawing the shape free form).

Further, the lighting control application is configured to identify pre-existing shapes associated with some or all of the luminaries 4 already installed or otherwise present in the environment 2 in question (e.g. a given room). E.g. each of the shapes being identified by the application could be the shape of the housing, diffuser, lamp or cluster of lamps comprised by a given one of the luminaires 4; or even the shape of a cluster of the luminaires 4. The identification of the shape of a luminaire 4 or cluster of luminaires 4 could be achieved in a number of ways. For example, the lighting control application may use known IDs of the luminaires 4 to look up their respective shapes in a look-up table or database mapping the IDs to an indication of the shape (where the look-up table or database may be stored locally on the user terminal 8 or elsewhere such as on a server which the user terminal 8 connects to via any suitable wired or wireless means such as those discussed above) As another example, the lighting control application may know or look-up (based on their IDs) a model type of each of the luminaires 4, and may be preconfigured with predetermined knowledge of the shape of each model. As yet another example, the system may comprise one or more cameras and/or other sensors which the user terminal 8 may use to detect the shape of a given luminaire 4 or cluster of luminaires 4 in the environment 2.

The lighting control application then matches each of one, some or all of the identified shapes in the image to the shape of a different respective one of the luminaires 4 or a different respective cluster of the luminaires 4. Preferably this may comprise determining the shape associated with each of a plurality of luminaires 4 or groups of luminaires present within the environment 2, such that the matching comprises selecting which of the multiple shapes best matches the image segment(s). Alternatively however it is also possible that the process may comprise determining the shape associated with only one luminaire 4 in the environment 2, such that the matching comprises determining whether or not the shape matches the image segment or one of the image segments (i.e. the luminaire is matched to the image segment on condition that the shapes match). Or one of a plurality of image segments could be matched to the single luminaire in dependence on which image segment best matches the shape of luminaire.

Note also that a match herein does not necessarily means the shapes have to be identical, but rather can also mean the shapes are an approximation of one another.

To create the lighting scene, the lighting control application then samples a colour and/or brightness level from each of the segments in the image corresponding to the identified shapes, and controls the illumination from the respective luminaires 4 to match the sampled value(s). Again, matching does not necessarily mean using the exact sampled value(s), but can also refer to an approximation. For example, the lighting control application may sample the colour and/or brightness of a representative point in the identified segment in the image, and use the representative colour and/or brightness values as those with which to emit the illumination from the respective matched luminaire 4. Or the lighting control application may combine (e.g. average) the colour and/or brightness values of a plurality of points of the identified segment in the image, and use the combined colour and/or brightness values as those with which to emit the illumination from the respective matched luminaire 4. In yet another example, the luminaire 4 in question may comprise a plurality of individually controllable light emitting elements at different spatial positions within the luminaire 4, like pixels. In this case, if the brightness and/or colour of the image segment varies spatially over that segment, then the different elements of the luminaire 4 accordingly to represent this variation. A particular non limiting example of this is pixelated strip lighting, as mentioned earlier.

Figure 2:
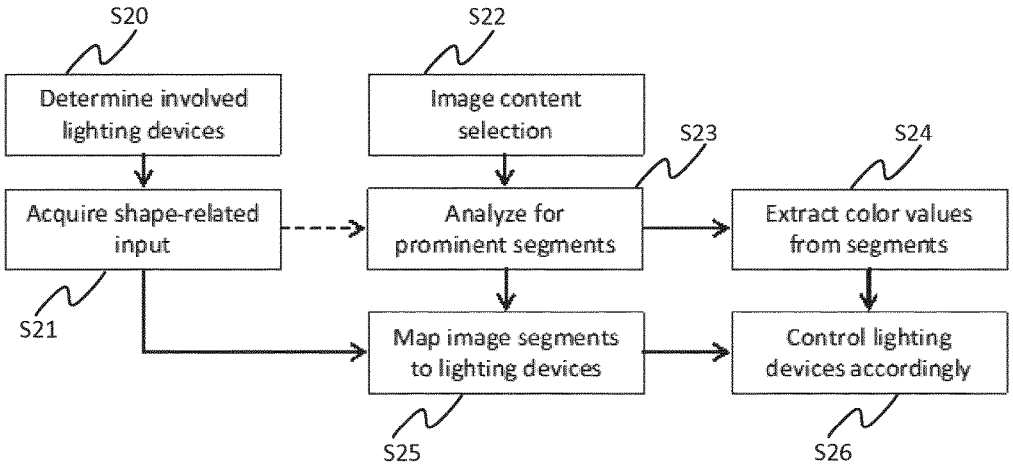
FIG. 2 is a flow chart of a process for matching image segments to luminaires.

FIG. 2 describes an example process flow in accordance with embodiments disclosed herein.

At step S20, the lighting control application determines which luminaires 4 are to be involved. The starting point of the method is to determine which luminaires 4 are available, relevant or desired for use in the current lighting scene creation process. For instance, the system may work in terms of "room groups" whereby each room group refers to a set of luminaires in a respective room, and when the user 10 selects the room group or the system detects the user 10 (or user control device 8) being present in that room, this set of luminaires 4 gets selected automatically. Alternatively, it is also possible to automatically select a set of luminaires 4 near the user (based on any suitable localization technology), or a set of luminaires 4 most suitable for image-based light scene creation (e.g. depending on which luminaires 4 are able to render colours, which are known to be previously or frequently involved in image-based lighting scenes, and/or which have a good shape match with detected prominent image segments if this has been determined already). As another alternative, the lighting control application may enable the user to manually select the luminaires 4 he or she wants to involve in the light scene creation process. A combination of any two or more such factors could also be used.

At step S21, the lighting control application acquires shape-related input from the involved luminaires 4, indicative of a shape associated with each of the luminaires 4. As mentioned, this could be the overall shape of the luminaire or its diffuser, the shape of its light effect, or a shape of an individual lamp within the luminaire. The following examples may be described in terms of the shape of a luminaire 4, or such like, but it will be understood that other such shapes associated with the luminaires 4 are also intended to be covered by the scope of the application.

Step S21 can be implemented in various ways. For instance, the way in which the shape-related input is derived from the involved luminaires 4 can range from basic to more sophisticated, which is illustrated by the following four example embodiments.

A first embodiment is to simply distinguish linear from non-linear luminaires 4. In this embodiment, the lighting control application just distinguishes substantially linear luminaires (e.g. comprising a LED line or LED strip) from substantially non-linear lighting devices (e.g. comprising an LED bulb or a lampshade). In this case, the image analysis is able to detect image colour patterns which are substantially linear shaped and/or image color patterns which are substantially blob shaped (circular or at least more rounded). The lighting control application then controls the linear luminaires(s) based on color values derived from the linear shaped image segments, and controls the non-linear luminaires using color values derived from the blob-shaped image segments. Similar techniques could be used to distinguish between other discrete categories of shape, e.g. to distinguish between more rounded shapes and more square or rectangular (box like) categories of shape. Suitable shape-recognition algorithms for placing a metric on the roundness, linearity or rectangularity of a shape are in themselves known to a person skilled in the art of image processing, and by placing thresholds on one or more such metrics then these can be used to categorize a given shape as being in either one discrete category or the other.

A second embodiment is to acquire shape-related input from a type and/or mounting of the luminaires 4. In this embodiment, the lighting control application acquires detailed input related to the shape of the luminaires or the effect generated by the luminaires 4. This shape-related information may be derived from various sources, such as the luminaire type (e.g. LED strip, LED spot, or a particular type of free-standing luminaire); or may be indicated by the user in a configuration procedure (e.g. horizontal LED strip, lighting downwards); or may be derived from sensors integrated into the luminaire 4 (e.g. orientation sensor, shape-detection sensing integrated into the LED strip).

A third embodiment is to acquire shape-related input by detecting and analyzing effects of the luminaire 4. In this embodiment, next to acquiring the above-mentioned information of all involved luminaires 4, a vision sensor (camera) is used to capture properties related to the effect shape of each individual luminaire 4. This can be achieved by a connected camera or smart device applied during a configuration procedure in which each of the involved luminaires 4 briefly generates one or more light effects, which can be visible or invisible to the human eye. Alternatively, a more sophisticated lighting device may have an integrated vision sensor on board which is able to detect such shape-related effect properties. As another alternative, the shape of the effects may be acquired e.g. from a databased with illumination profiles (light distributions) of the various luminaires 4 mapped to luminaire IDs or model types.

A fourth embodiment is based on grouping of luminaire shapes. It is also an option that the shapes of individual luminaire 4 are combined into a new shape, and pattern matching is used to map the combined shape(s) to the image segments. In this case the combined shape is assembled from the individual shapes of the luminaires 4 and their position relative to each other or their absolute position in an arrangement of shapes. It is also possible that the combined shape is delivered by a single luminaire that has a coordinating role in the group of luminaires.

Step S22 is the image content selection step. Here the user can give input for image content selection in different ways. For instance, the user may select or search for a suitable still image or video image. Or the user may enter a spoken or typed keyword (e.g. relax, ocean, sunrise) and have the system search and select image content based on this. In a further extension of this, the lighting control application receives and analyzes more than a single image based on the user selection or keyword. For instance, the system may analyze multiple "sunrise" images (which have a high color similarity), and selects features or segments from multiple sunrise images, and may select those segments from multiple images which best match the shapes of the available luminaires 4 or their effects. In this multi-image approach, knowledge may also be used on matching colors in order to avoid combining colors that do not match well.

At step S23 the lighting control application analyses the selected image for prominent segments. As indicated above, it is possible that the image analysis takes the list of available luminaires 4 and associated shapes or effect shapes into account. Next to this, the lighting control application may also take into account further rendering properties and capabilities of the luminaire 4 into account. For instance, in the case of a pixelated LED strip the image analyzer may try to detect a substantially linear image segment with color variation whereas in the case of a single-color LED strip the image analyzer may try to find linear image segments that have limited color variation along the segment. Another input could be the (relative or approximate) location of the lighting device in the room, possibly relative to the user or the user control device. For instance, if a LED strip is installed close to the floor, the image analyzer may try to find a linear image segment in the bottom part of the picture. As another possibility, the segments could be manually selected by the user, such as by drawing a shape free-form, or using a predetermined shape type (e.g. a rectangle or ellipse of variable size and/or dimensions) or dragging-and-dropping a predetermined shape. Any combination of two or more such techniques could also be used.

At step S24 the lighting control application extracts colour values from the identified image segments. The colour values can be extracted from the image in any of a number of possible ways that are in themselves known in the art. E.g. this may be performed by creating a colour histogram and determining the most frequently occurring colour or colours in the image segment. Another option is to create a palette from the segment using an algorithm such as a vector quantization, K-means, etc., and to select a dominant colour from the palette. Another option is to average the values, over the segment, on each of the channels in a colour space such as RGB, YUV, etc.

Note also that steps S22 to S24 could be performed before or after steps S20 to S21.

At step 25 the lighting control application maps the image segments to luminaires 4. Once the image has been analyzed for prominent segments, the resulting color values and color patterns are mapped to the most relevant luminaires 4 based on matching the shapes. At step 26 the lighting control application controls the luminaires 4 accordingly.

Figure 3:
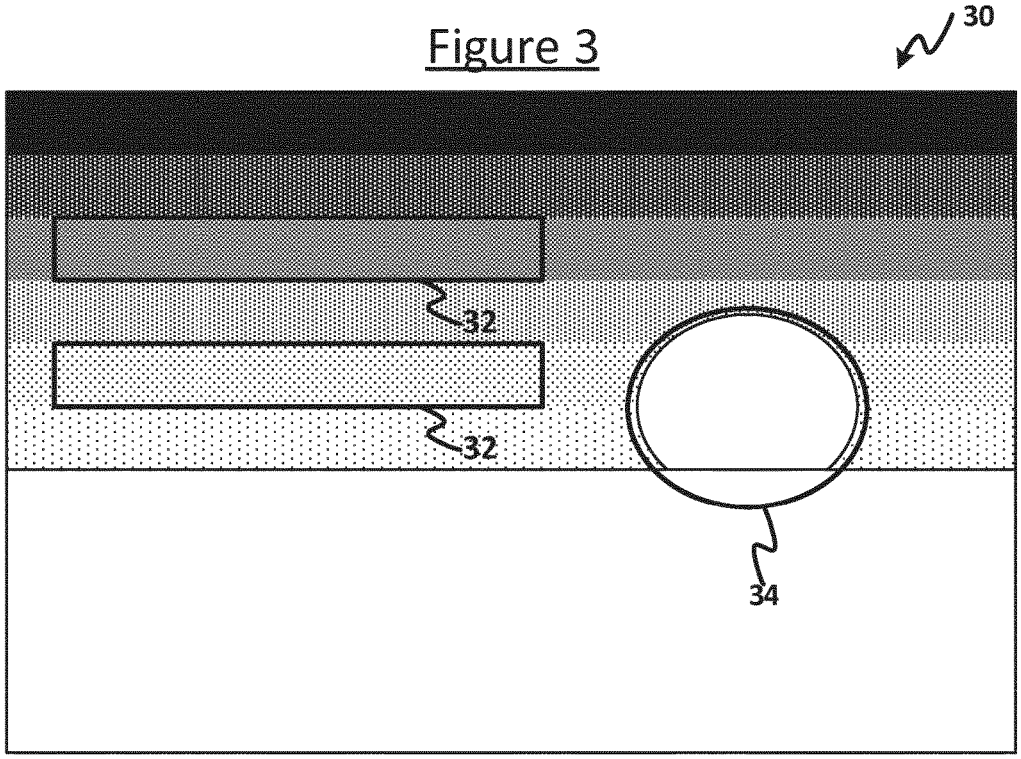
FIG. 3 shows an example of shapes being identified based on an image.
Figure 4:
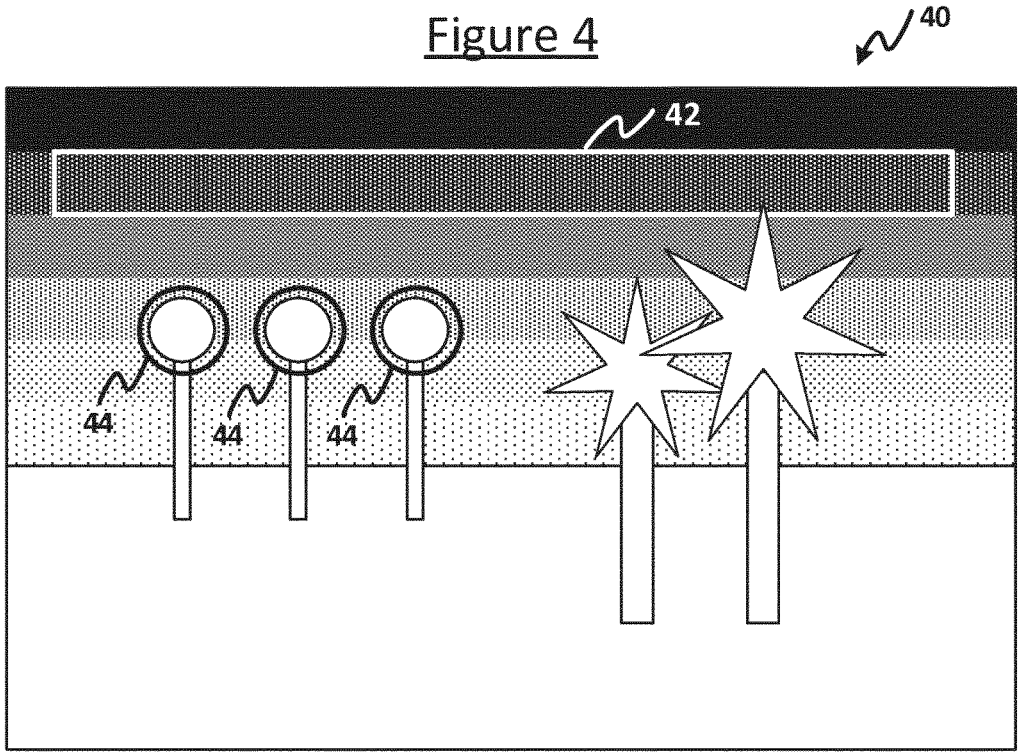
FIG. 4 shows another example of shapes being identified in an image.

Some examples are illustrated in FIGS. 3 and 4. FIG. 3 shows a photograph 30 of a sunset as the input image, while FIG. 4 shows an example in which the user 10 has selected a photograph 40 of a beach with palm trees as the input image. Whichever is chosen, the lighting control application then identifies segments 32, 34, 42, 44 in the image 30, 40 which correspond approximately to the shapes of luminaires 4 in the environment 2. For instance, say a customer has two LED strips and one more rounded or point-like LED luminaire installed in a room. In this case, the selection could be as shown in FIG. 3: the strips are mapped to segments 32 with a color gradient substantially parallel to the horizon (where there is a subtle difference in color between pixels) and the other is mapped to a segment 34 corresponding to the sun (which has an orb-like shape). As a further example, if a user has a single LED strip, the mapping could be performed as in FIG. 4: a linear segment 42 in the image is selected that has a pleasant color distribution (e.g. a constant colour or smooth variation along the strip, whereas if the selected line was placed lower, it would cross the palm trees); while more rounded objects 44 in the image (e.g. outdoor luminaires captured in the photograph) are each mapped to a respective one of the rounded luminaires 4 in the environment 2.

Next to the shape-related information, also further rendering properties and capabilities of the individual luminaires 4 be taken into account here. For instance, if an image segment shows a clear bright spot (e.g. the sun on in FIG. 3) it makes sense to assign this colour value including the high brightness associated with the image segment to a luminaire 4 which is able to render this bright spot with the proper light intensity and size.

It will be appreciated that the above embodiments have been described only by way of example. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A method for creating a lighting scene illuminating an environment, the method comprising:

receiving a still or moving input image;

identifying one or more image segments within the input image, including determining a shape of each of the one or more image segments;

determining a respective colour and/or brightness level of each of the one or more identified image segments;

determining a shape associated with each of one or more luminaires present within said environment, or with each of one or more groups of said luminaires present within said environment;

matching the shape of each of the one or more identified image segments to the shape associated with a respective one of said luminaires or a respective one of said groups of said luminaires; and for each respective of the one or more identified image segments, controlling the respective luminaire or group of luminaires to emit light with a colour selected based on the colour of the respective image segment and/or with a brightness level selected based on the brightness level of the respective image segment.

2. The method of claim 1, wherein the identification of at least one, or each, of said image segments is performed by using an image recognition algorithm to recognize a corresponding object or region in the input image.

3. The method of claim 2, wherein the recognition is based on the determined shape associated with each of the one or more luminaires, the image recognition algorithm searching the input image for the corresponding object or regions so as to be suitable for matching to the shape of the image segments.

4. The method of claim 1, wherein the identification of at least one, or each, of said image segments is performed by receiving a manual user selection of a user-selected region in the input image.

5. The method of claim 4, wherein the user-selected region is either:

drawn free-form over the input image by a user, drawn using a predetermined form having user-variable size and/or dimensions, or selected by a user dragging-and-dropping a predefined shape over the input image.

6. The method of claim 1, wherein said matching comprises matching the shape of at least one, or each, of the identified image segments to a shape associated with an individual respective one of said one or more luminaires; and wherein the shape associated with at least one, or each, of the individual respective luminaires is a shape of the individual luminaire, or a shape of a light emitting or diffusing part of the individual luminaire, or a shape of a group of light emitting or diffusing parts of the individual luminaire.

7. The method of claim 1, wherein said matching comprises matching the shape of at least one, or each, of the identified image segments to a shape associated with an individual respective one of said one or more luminaires; and wherein the shape associated with at least one, or each, of the individual respective luminaires is a shape of a lighting effect cast by the respective luminaire.

8. The method of claim 1, wherein said one or more luminaires are a plurality of luminaires; and said matching comprises matching the shape of at least one, or each, of the identified image segments to a shape associated with a group of said luminaires; and wherein the associated shape is a combined shape of the group.

9. The method of claim 1, wherein said one or more luminaires are a plurality of luminaires, and said one or more identified image segments are a plurality of different image segments within the input image and wherein said matching comprises matching the shape of each of the one or more identified image segments to the shape associated with a different respective one of said luminaires or a different respective group of said luminaires.

10. The method of claim 1, further comprising selecting said one or more of luminaires from amongst a larger number of luminaires, based on any one or more of:

which are in the same room as one another, which are in the same room as a user, which are within a predetermined proximity of a user, a manual selection by a user, and/or which are most suitable for scene creation according to one or more predetermined criteria.

11. The method of claim 1, wherein:

the determination of the shape of each of the one or more image segments comprises categorizing the shape as either a first discrete category of shape or a second discrete category of shape, the first category defining more linear, rectangular and/or square forms of shape, while the second category defines more rounded shapes;

the determination of the shape associated with each of the luminaires or groups of luminaires comprises categorizing the shape as either the first category of shape or the second category of shape; and said matching comprises matching at least one, or each, of the linear image segments to a linear one of said luminaires or groups on basis of both being linear, and/or matching at least one, or each, of the round image segments to a round one of said luminaires or groups of luminaires on basis of both being round.

12. The method of claim 1, wherein the determination of the shape associated with each of the one or more luminaires or group of luminaires is based on any one or more of:

using an ID of the luminaire or group to look up the associated shape in a data store mapping IDs to shapes;

determining a model of the luminaire, wherein a predetermined shape is assumed to be associated with the model;

using a camera and/or one or more other sensors to detect the associated shape;

and/or a user input indicating the associated shape.

13. The method of claim 1, wherein the input image is selected by a user.

14. A computer program product comprising code embodied on a computer-readable storage medium and configured so as when run on one or more processors to perform the steps of:

receiving a still or moving input image;

identifying one or more image segments within the input image, including determining a shape of each of the one or more image segments;

determining a respective colour and/or brightness level of each of the one or more identified image segments;

determining a shape associated with each of one or more luminaires present within said environment, or with each of one or more groups of said luminaires present within said environment;

matching the shape of each of the one or more identified image segments to the shape associated with a respective one of said luminaires or a respective one of said groups of said luminaires; and for each respective of the one or more identified image segments, controlling the respective luminaire or group of luminaires to emit light with a colour selected based on the colour of the respective image segment and/or with a brightness level selected based on the brightness level of the respective image segment.

15. An apparatus comprising a lighting control device-configured to perform the steps of:

receiving a still or moving input image;

identifying one or more image segments within the input image, including determining a shape of each of the one or more image segments;

determining a respective colour and/or brightness level of each of the one or more identified image segments;

determining a shape associated with each of one or more luminaires present within said environment, or with each of one or more groups of said luminaires present within said environment;

matching the shape of each of the one or more identified image segments to the shape associated with a respective one of said luminaires or a respective one of said groups of said luminaires; and for each respective of the one or more identified image segments, controlling the respective luminaire or group of luminaires to emit light with a colour selected based on the colour of the respective image segment and/or with a brightness level selected based on the brightness level of the respective image segment.

* * * * *